US007796089B2

(12) United States Patent
Zwick et al.

(10) Patent No.: US 7,796,089 B2
(45) Date of Patent: Sep. 14, 2010

(54) ANTENNA SYSTEM FOR A PORTABLE COMMUNICATIONS DEVICE

(75) Inventors: David J. Zwick, Pittsford, NY (US); Malcolm Packer, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 956 days.

(21) Appl. No.: 11/565,809

(22) Filed: Dec. 1, 2006

(65) Prior Publication Data

US 2008/0129607 A1 Jun. 5, 2008

(51) Int. Cl.
*H01Q 1/12* (2006.01)
*H01Q 1/24* (2006.01)

(52) U.S. Cl. ..... 343/718; 343/702

(58) Field of Classification Search ..... 343/702, 343/718, 872, 860

See application file for complete search history.

(56) References Cited

U.S. PATENT DOCUMENTS

| | | | | |
|---|---|---|---|---|
| 1,640,929 | A | 8/1927 | Farkouh | |
| 2,470,687 | A | 5/1949 | Carfella et al. | |
| 4,966,320 | A | 10/1990 | DeSantis et al. | |
| 5,819,162 | A * | 10/1998 | Spann et al. | 455/575.5 |
| 6,919,850 | B2 * | 7/2005 | Kennedy et al. | 343/718 |
| 2002/0009976 | A1 * | 1/2002 | Rashidi | 455/90 |
| 2002/0017545 | A1 | 2/2002 | Badillo et al. | |
| 2006/0022822 | A1 * | 2/2006 | Wong et al. | 340/568.1 |
| 2006/0099993 | A1 | 5/2006 | Leinonen et al. | |

FOREIGN PATENT DOCUMENTS

| | | |
|---|---|---|
| DE | 29908816 | 9/2000 |
| EP | 0 846 440 | 6/1998 |

* cited by examiner

*Primary Examiner*—Shih-Chao Chen
(74) *Attorney, Agent, or Firm*—Fox Rothschild, LLP; Robert J. Sacco

(57) ABSTRACT

An antenna system (100, 500) for a portable communication device (112) is provided. The antenna system is comprised of a retaining structure (204), an antenna flap (206), and a first pivot coupling (212). The retaining structure provides a means for securing the retaining structure to the portable communication device. The antenna flap includes an antenna structure (302). The antenna structure is comprised of an antenna radiating element (600) and/or an antenna impedance matching network (652). The first pivot coupling pivotally connects the antenna flap to the retaining structure. The first pivot coupling is configured to allow the antenna flap to pivot freely on the first pivot coupling responsive to a force of gravity acting on the antenna flap. The retaining structure is configured as a holster in which the portable communication device can be disposed.

22 Claims, 6 Drawing Sheets

ANTENNA SYSTEM FOR A PORTABLE COMMUNICATIONS DEVICE

BACKGROUND OF THE INVENTION

1. Statement of the Technical Field

The inventive arrangements relate to antennas and holsters for carrying portable communications devices. More particularly, the present invention relates to holsters having an antenna coupled thereto or embedded therein for use with portable battery powered communications devices.

2. Description of the Related Art

Conventional portable communication systems are often comprised of a portable communications device and a holster. The portable communications device is often comprised of a casing, an internal circuitry, and an antenna. The casing provides a means for protecting the internal circuitry from damage due to an external factor, such as water and vibration forces. The internal circuitry provides a means for generating radio frequency (RF) signals that are to be transmitted to an external device and for processing received RF signals that are to be outputted to an operator. The antenna is mechanically coupled to the casing and electrically coupled to the internal circuitry. The antenna provides the means for the internal circuitry to transmit and receive RF signals. The antenna typically protrudes twelve (12) to thirteen (13) inches above a top surface of the portable communications device.

The holster is often designed for carrying the portable communications device on a person's belt. However, the holster can also be designed for carrying the portable communications device on a person's shoulder, leg, or chest. Typically, the holster is formed from a suitable material (such as a canvas, a nylon, a plastic and/or a leather) and is absent of any embedded electronic or other radio components (such as an antenna).

Despite the advantages of such a conventional portable communications system, it suffers from certain drawbacks. For example, assuming that military personnel is in a dense vegetation or a Department of Homeland Security (DHS) personnel is in a confined space in an urban environment, the protruding antenna can restrict the personnel's mobility thereby placing them in harms way.

As such, research is being done on a variety of new antenna technologies to eliminate any restrictions on an operator's mobility. One such antenna technology includes embedding an antenna within a casing of a portable communications device. This antenna architecture requires an aperture or a dielectric casing which is undesirable due to the sensitivity of a portable communications device's internal circuitry. Another such antenna technology includes remotely mounting an antenna on a vehicle. Nevertheless, this architecture is undesirable because an operator's mobility is still restricted.

In view of the forgoing, there remains a need for a portable communications system that is absent of a protruding antenna. The portable communications system also needs to require minimal operator training, is relatively inexpensive, and is absent of an aperture or a dielectric casing. The portable communications system further needs to have an easy installation feature, a suitable radio frequency performance feature, and a rugged, durability feature.

SUMMARY OF THE INVENTION

The invention concerns an antenna system for a portable communication device. The antenna system is comprised of a retaining structure, an antenna flap, and a first pivot coupling. The retaining structure provides a means for securing the retaining structure to the portable communication device. The antenna flap includes an antenna radiating element. The first pivot coupling pivotally connects the antenna flap to the retaining structure. The first pivot coupling is configured to allow the antenna flap to pivot freely on the first pivot coupling responsive to a force of gravity acting on the antenna flap.

According to an aspect of the invention, the retaining structure is configured as a holster in which the portable communication device can be disposed. The holster is comprised of a second pivot coupling. The second pivot coupling pivotally connects the holster to a support flap. The support flap is comprised of one or more flap securing structures configured to secure the support flap to a user.

The first pivot coupling is disposed on a first side of the holster. The second pivot coupling is disposed on a second side of the holster opposed from the first side. The first pivot coupling is disposed at a location on the holster which is adjacent to an upper portion of the portable communication device opposed from the second pivot coupling.

According to another aspect of the invention, the antenna flap is a planar structure. The planar structure has a peripheral edge which conforms to an exterior profile of the portable communication device. The first pivot coupling and the planar structure are each positioned so that the planar structure can automatically pivot to a position adjacent to an exterior panel of the portable communication device when the portable communication device is stored in the holster.

According to another aspect of the invention, the antenna radiating element is disposed on an antenna structure formed of a planar dielectric substrate. The antenna flap is further comprised of an antenna impedance matching network. The first pivot coupling is comprised of a fabric web forming a portion of the holster. According to yet another aspect of the invention, the retaining structure is configured to releasably secure the antenna flap to a case of the probable communications device in a manner that is exclusive of an RF connector.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Embodiments of the present invention will now be described with respect to FIGS. 1-7. Some embodiments of the present invention provide an antenna system including a holster configured for carrying a portable, battery powered communications device. Such embodiments also provide an antenna system having an antenna radiating element coupled to the holster or embedded in the holster. Such embodiments further provide an antenna system configured for optimal performance. For example, some embodiments advantageously allow an antenna structure to freely move on a pivot coupling such that an antenna radiating element remains in a position that is perpendicular to a direction of a transmitted/received signal's propagation path.

Figure 1:
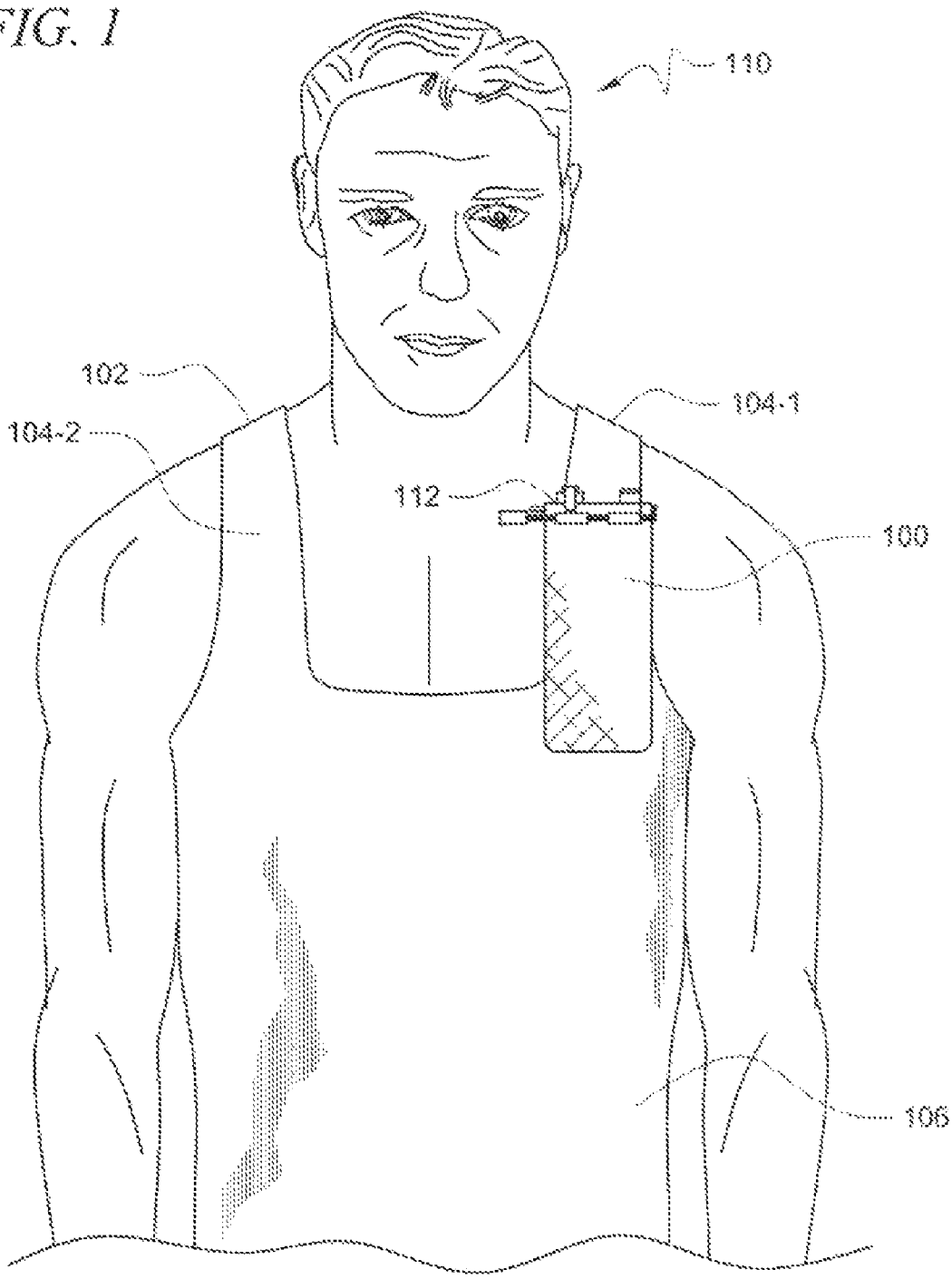
FIG. 1 is a front view of a user wearing a holster for a portable radio, which is useful for understanding the present invention.

Referring now to FIG. 1, there is provided a front view of an antenna system 100 that is useful for understanding the present invention. As shown in FIG. 1, the antenna system 100 is configured to be worn by a user 110 (for example, a military person, a paramilitary person, or a rescue person). Accordingly, the antenna system 100 provides a securing means (not shown) for securing a communication device 112 to the user 110. In this regard, it should be understood that the antenna system 100 is detachably coupled to a harness 102 (such as a web gear harness used by military personnel, a harness used by paramilitary personnel, or a harness used by rescue personnel). The harness 102 is comprised of chest straps 104-1, 104-2 a front torso portion 106, and a back torso portion (not shown). The antenna system 100 is advantageously coupled to a chest strap 104-1 such that the communications device 112 is easily accessible to the user 110. The antenna system 100 is also coupled to a chest strap 104-1 such that a speaker (not shown) of the communications device 112 is adjacent to and directed towards the chest of the user 110.

Figure 2:
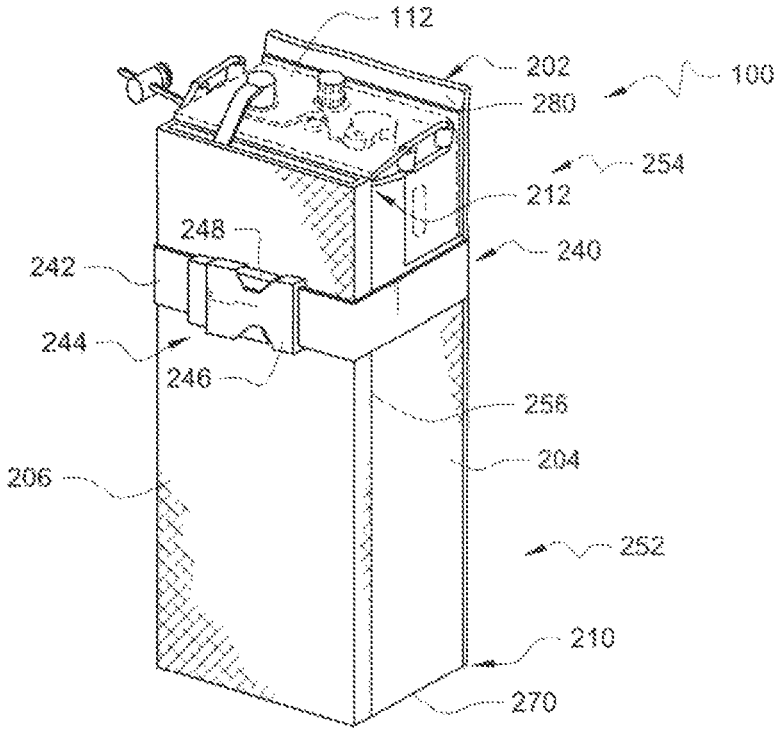
FIG. 2 is a front perspective view of the antenna system in FIG. 1 in a closed position that is useful for understanding the present invention.
Figure 3:
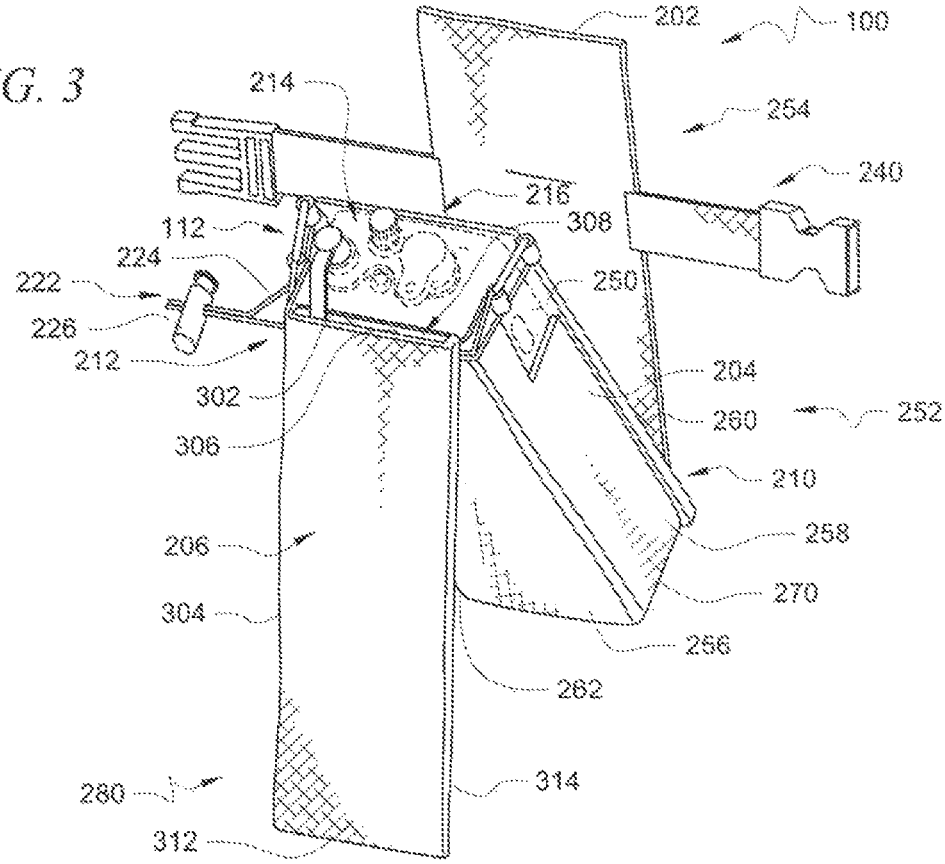
FIG. 3 is a front perspective view of the antenna system in FIG. 1 in an open position that is useful for understanding the present invention.

Referring now to FIG. 2, there is provided a perspective view of the antenna system 100 in a closed position that is useful for understanding the present invention. A perspective view of the antenna system 100 in an open position is provided in FIG. 3. As shown in FIGS. 2-3, the antenna system 100 is comprised of a support flap 202, a retaining structure 204, and an antenna flap 206. According to one embodiment of the invention, the retaining structure 204 can be a holster or a case for retaining an antenna flap 206 to a communications device 112. However, the invention is not limited in this regard.

The above listed components 202, 204, 206 are comprised of any material suitable for a particular antenna system 100 application. For example, in an embodiment of the invention, the components 202, 240, 206 are comprised of a natural material (such as leather) and/or a synthetic material (such as a canvas material, a nylon material, a vinyl material, or a cordura material). The listed components 202, 204, 206 are also formed using any suitable means known in the art. For example, the listed components 202, 204, 206 are fabric webs formed by coupling pieces of natural materials and/or synthetic materials together. This coupling of fabrics is achieved through the use of a stitching means and/or an adhesive means.

Referring again to FIGS. 2-3, the support flap 202 has a generally planar construction and provides a means for detachably coupling the antenna system 100 to a user 110 (described above in relation to FIG. 1). According to an embodiment of the invention, the support flap 202 extends upwardly from a pivot coupling 210 and is adapted for fastening on a harness 102 (described above in relation to FIG. 1). In this regard, it should be appreciated that any means known in the art for fastening to a harness can be used without limitation.

The support flap 202 is pivotally coupled to the retaining structure 204 by the pivot coupling 210. The pivot coupling 210 is disposed on a bottom side 252 of the antenna system 100 such that the pivot coupling 210 is adjacent to a lower portion of the communications device 112. The pivot coupling 210 is comprised of any structure or mechanism suitable for allowing the retaining structure 204 to pivot freely on the pivot coupling 210 when a force of gravity acts on the retaining structure 204. In this regard, it should be appreciated that the pivot coupling 210 can be a fabric web formed using any suitable means known in the art. For example, the pivot coupling 210 is a fabric web formed by stitching pieces of natural materials and/or synthetic materials together.

Similarly, the antenna flap 206 preferably has a planar construction and is pivotally coupled to the retaining structure 204 by a pivot coupling 212. The pivot coupling 212 is disposed on a top side 254 of the antenna system 100 such that the pivot coupling 212 is adjacent to an upper portion of the communications device 112 opposed from the pivot coupling 210. The pivot coupling 212 is comprised of any structure or mechanism suitable for allowing the antenna flap 206 to pivot freely on the pivot coupling 212 when a force of gravity acts on the antenna flap 206. In this regard, it should be appreciated that the pivot coupling 212 can be a fabric web formed of any suitable means known in the art. For example, the pivot coupling 212 is a fabric web formed by stitching pieces of natural materials and/or synthetic materials together.

As noted above, the retaining structure 204 can be arranged as a holster or a case formed of a fabric or web like material. However, the invention is not limited in this regard. In fact, the retaining structure 204 can be any structure capable of accommodating a pivot connection as described herein between a shell or case of the handheld communications device 112, the support flap 202, and the antenna flap 206. Thus, it will be readily understood by those skilled in the art that the retaining structure 204 can be formed in a variety of ways, all of which are intended to be included within the scope of the present invention. For example, the retaining structure 204 could be formed as a first metal clip attached to an upper portion of the communications device 112 adjacent to the pivot coupling 212, and a second metal clip attached to a low portion of the communications device 112 adjacent to the pivot coupling 210. Other alternatives are also possible. For example, strap or elastic band could be used in place of the metal clips to secure the pivot couplings for the antenna flap 206 and the support flap 202 to the communications device 122. Alternatively, hook and loop type fasteners could be used to secure a pivot coupling 210, 212 to the communications device 112. In this regard, it should also be understood that the pivot couplings 210, 212 are not limited to pivot couplings formed from fabric, webbing or other flexible material. Any other type of pivot coupling can also be used for this purpose.

As shown by FIGS. 2-3, the antenna system 100 can be selectively transitioned between a closed position and an open position. In the closed position as shown in FIG. 2, the retaining structure 204 is adjacent to an exterior panel 280 of the support flap 202. In the closed position, the antenna flap 206 is adjacent to an exterior panel 256 (also referred to herein as a sidewall structure) of the retaining structure 204. As shown in FIG. 2, a fastening mechanism 240 is provided for retaining the antenna system 100 is in this closed position. For example, the fastening mechanism 240 is comprised of a strap 242 and a buckle 244. The buckle 244 has a male component 246 and a female component 248. The strap 242 is coupled to the support flap 202 and is adapted to fit around the retaining structure 204 and the antenna flap 206. The female component 248 is configured to be partially inserted into the male component 246 so that when the buckle 244 is fully engaged the antenna system 100 is retained in this closed position. Of course, other fastening mechanisms are also possible. For example, hook and loop fasteners can also be used to releasably secure the support flap 202 and the antenna flap 206 to the retaining structure 204.

In the open position as shown in FIG. 3, the fastening mechanism 240 is disengaged such that the retaining structure 204 pivots freely on the pivot coupling 210. In effect, the retaining structure 204 can be selectively moved to a desired angle position (for example, a forty-five degree (45°) angle position) with respect to the support flap 202. Similarly, the antenna flap 206 pivots freely on the pivot coupling 212. As such, the antenna flap 206 can be selectively moved to a desired angle position (for example, a forty-five degree (45°) angle position) with respect to the retaining structure 204. It should be appreciated that this configuration advantageously provides a means to allow the antenna flap 206 to continuously reside in a position that is perpendicular to a direction of a transmitted/received signal's propagation path (not shown).

In the embodiment of the invention shown in FIG. 3, the retaining structure 204 is configured as a holster that defines a compartment 214 in which the communications device 112 can be disposed. As such, the compartment 214 has a predetermined size and shape in accordance with a particular antenna system 100 application. For example, the retaining structure 204 defines a compartment 214 having a shape which conforms to an exterior profile of the communications device 112.

According to an embodiment of the invention, the compartment 214 has a top opening 216 configured to receive at least a portion of the communications device 112. The compartment 214 also has a bottom structure 270 and sidewall structures 256, 258, 260, 262. The sidewall structures 256, 258, 260, 262 extend downward from the top opening 216. The bottom structure 270 and the sidewall structures 256, 258, 260, 262 collectively provide a means for carrying the communications device 112. The structures 270, 256, 258, 260, 262 also provide a means for protecting the communications device 112 from damage due to environmental hazards (such as sand and water) and external forces (such as a collision force). The sidewall structures 256, 258, 260, 262 and the pivot coupling 212 collectively provide a means for coupling the antenna flap 206 to a case 250 of the communications device 112. Still, the invention is not limited in this regard. The compartment 214 can be designed in accordance with a particular antenna system 100 application.

Referring again to FIG. 3, the retaining structure 204 is comprised of a mechanism 222 for releasably securing the retaining structure 204 to the portable communications device 112. The mechanism 222 can be advantageously comprised of either a clamping structure or a compression structure for engaging the case 250 of the communications device 112. According to an embodiment of the invention, the mechanism 222 is comprised of a compression structure including a cord 224 and a cord lock 226. Still, the invention is not limited in this regard.

An antenna structure 302 is secured to the antenna flap 206. For example, the antenna structure 302 can be secured on or in the antenna flap 206. According to a preferred embodiment, the antenna structure 302 is releasably secured to the antenna flap 206. As such, the antenna flap 206 has a predetermined size and shape in accordance with a particular antenna system 100 application. For example, in the embodiment shown, the antenna flap 206 is a planar structure having a peripheral edge 304 which conforms to an exterior profile of the communications device 112.

According to an embodiment of the invention, the antenna flap 206 defines a compartment 306 in which the antenna structure 302 can be disposed and/or embedded therein. The compartment 306 has a top opening 308 configured to receive at least a portion of the antenna structure 302. However, it should be understood that the top opening 308 may remain open such that the antenna structure 302 can be removed and selectively replaced with a different antenna structure. Alternatively, the top opening 308 may be sealed or stitched closed. The compartment 306 also has sidewall structures 321, 314. The sidewall structures 312, 314 extend downward from the top opening 308 and are coupled together. This coupling of the sidewall structures 312, 314 can be achieved through the use of a stitching means and/or an adhesive means. The sidewall structures 312, 314 collectively provide a means for carrying the antenna structure 302. The structures 312, 314 also provide a means for protecting the antenna structure 302 from damage due to environmental hazards (such as sand and water) and external forces (such as a collision force). Still, the invention is not limited in this regard. The compartment 326 can be designed in accordance with a particular antenna system 100 application.

Thus for, the invention has been described as including an antenna flap 206 that is distinct from the antenna structure 302. However, it should be understood that the invention is not limited in this regard. For example, the antenna flap 206 and the antenna structure 302 can form a single integrated circuit. In this embodiment, the antenna structure 302 can be thought of as being pivotally coupled to a case of the communications device 112 directly, rather than being a part of a separate antenna flap structure. It will be understood that an embodiment of the invention which includes an antenna flap 206 as shown can provide additional protection for the antenna structure 302 against shock, abrasion, moisture and dust. Ultimately, however, all that is necessary is a pivot coupling which attaches the antenna structure 302 to the case of the communications device as shown.

Referring again to FIG. 3, it should be understood that the antenna flap 206 can include a weight (not shown) coupled to or disposed in a bottom portion 280 of the antenna flap 206 such that the antenna flap 206 can automatically and freely swing about the pivot coupling 212 when the communications device 112 is in use, i.e., when the antenna system 100 is in the open position. As such, the antenna flap 206 can advantageously swing from a first position to a second position such that an antenna radiating element associated with the antenna structure 302 continuously provides optimal communications performance. In particular, the antenna radiating element can be arranged to always be oriented for a desired polarization.

It should also be understood that the antenna flap 206 can include sidewall structure 312, 314. The sidewall structures 312, 314 can have a securing means (not shown) configured to secure the antenna structure 302 thereto. Such securing means can include, but are not limited to, hook fasteners, hook-and-loop fasteners, elastic loop fasteners, mechanical belt fasteners, and adhesives. According to a preferred embodiment of the invention, such securing means can be selected to releasably secure the antenna structure 302 in or on the antenna flap 206.

Figure 4:
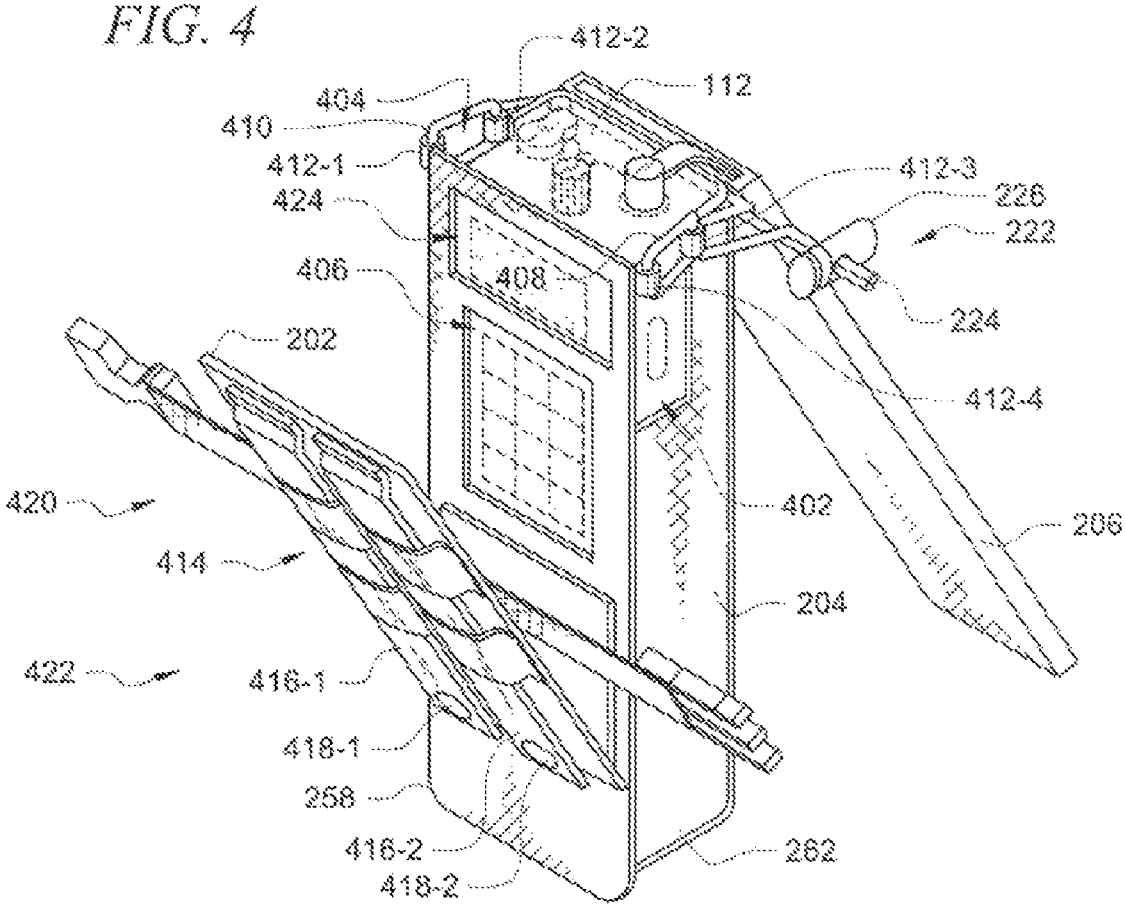
FIG. 4 is a rear perspective view of the antenna system in FIG. 1 that is useful for understanding the present invention.

Referring now to FIG. 4, there is provided a rear perspective view of the antenna system 100 that is useful for understanding the present invention. As shown in FIG. 4, the retaining structure 204 is comprised of one or more apertures 402, 404, 424, 406. The apertures 402, 404, 424, 406 are configured for externally exposing items (for example, control mechanisms, a speaker, and a display screen) on the communications device 112 when the communications device 112 is fully inserted into the retaining structure 204.

For example, the apertures 402, 404 are control apertures 402, 404. The aperture 424 is a speaker aperture 424. The aperture 406 is an interface aperture 406. Accordingly, the control apertures 402, 404 are sized and shaped to externally expose control mechanisms (not shown) of the communications device 112. Such control mechanisms can include, but are not limited to, and on/off switch, a band switch, and a volume control. The speaker aperture 424 is sized and shaped to externally expose a speaker of the combinations device 112. The interface aperture 406 is sized and shaped to externally expose a display screen and/or and input means (such as a keypad or a directional pad). It should be appreciated that all such apertures 402, 404, 424, 406 externally expose the corresponding items on the communications device 112 when the communications device 112 is fully inserted into the retaining structure 204. Accordingly, such corresponding times on the communications device 112 are externally accessible to a user 110 when the communications device 112 is stored in the retaining structure 204.

The retaining structure 204 is also comprised of loop couplers 412-1, 412-2, 412-3, 412-4 configured to couple flexible structures 408, 410 to the retaining structure 204. In this regard, it should be appreciated that the flexible structures 408, 410 are part of the mechanism 222 (described above in relation to FIG. 2). For example, in the embodiment shown, the mechanism 222 is comprised of a compression structure including a cord 224 and a cord lock 226. As such, each flexible structure 408, 410 is a portion of the cord 224 that is inserted into respective loop couplers 412-1, 412-2, 412-3, 412-4. As should be appreciated, this configuration provides a means to retain the communications device 112 within the retaining structure 204. Still, the invention is not limited in this regard. Any suitable means known in the art for coupling the flexible structures 408, 410 to the retaining structure 204 can be used without limitation. Also, the mechanism 222 can be advantageously comprised of any structure suitable for engaging the communications device 112.

As shown in FIG. 4, the support flap 202 is comprised of a flap securing structure 414 to secure the support flap 202 to a user 110 (not shown). According to an embodiment of the invention, the flap securing structure 414 is comprised of elongated, flexible structures 416-1, 416-2 and locking mechanisms 418-1, 418-2. A first end of the elongated, flexible structures 416-1, 416-2 is coupled to a top portion 420 of the support flap 202. The elongated, flexible structures 416-1, 416-2 are shaped and sized in accordance with a particular application. For example, the elongated, flexible structures 416-1, 416-2 are designed for insertion into a portion of a harness 102 (described above in relation to FIG. 1). The locking mechanisms 418-1, 418-2 are coupled to a bottom portion 422 of the support flap 202. The locking mechanisms 418-1, 418-2 provide a means for fastening a second end of the rigid structures 416-1, 416-2 to a bottom portion 422 of the support flap 202. The locking mechanisms 418-1, 418-2 can be any type known in the art. For example, the locking mechanisms 418-1, 418-2 can be snap fasteners, hook and loop fasteners, clips, buckles, and so on.

Figure 5:
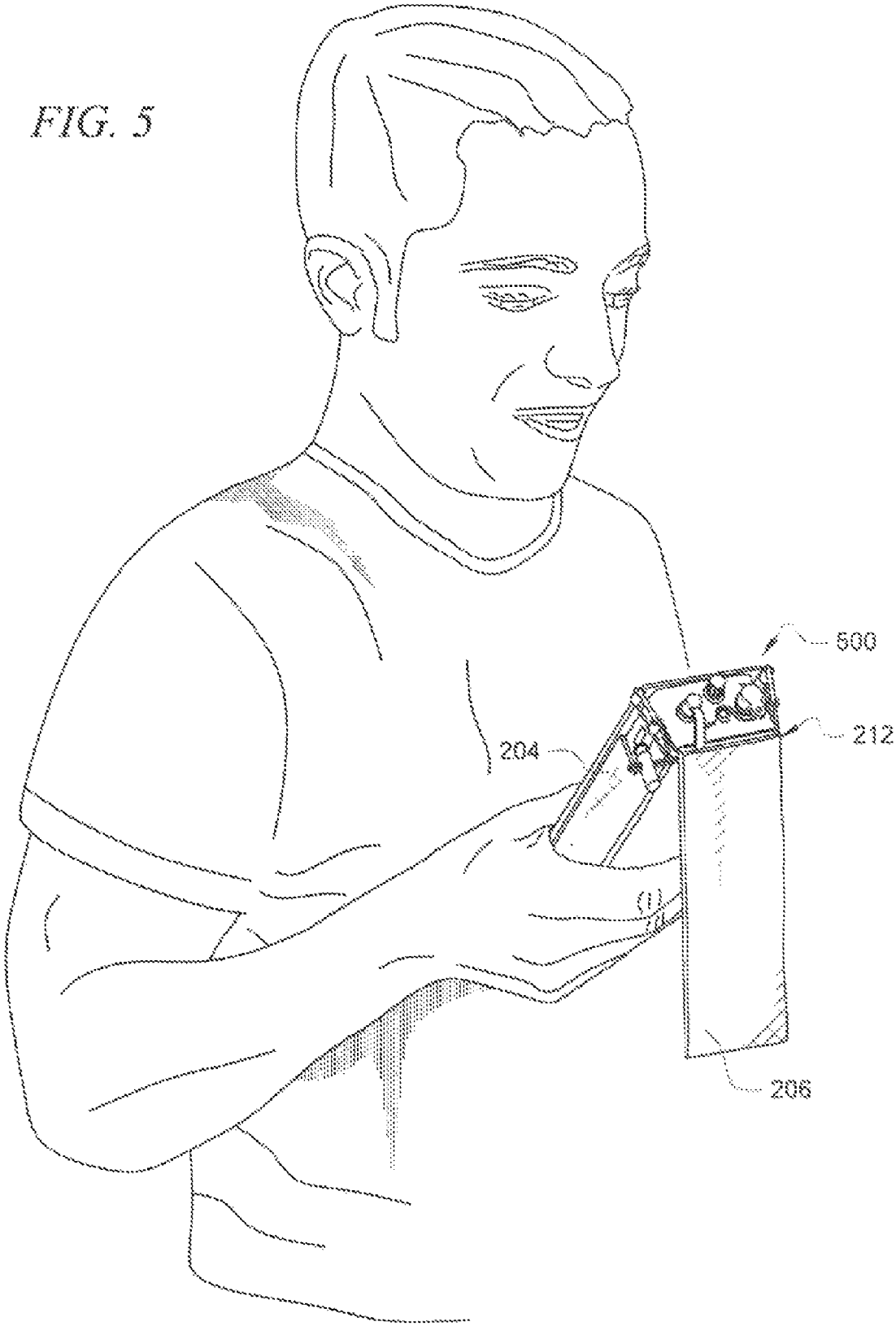
FIG. 5 is a rear perspective view of an alternative handheld embodiment of an antenna system that is useful for understanding the present invention.

Referring now to FIG. 5, an alternative embodiment of the invention is illustrated which does not include a support flap 202. Such an arrangement can be useful in those circumstances where a communications device is to be held in a user's hand, rather than attached to a user's chest. The antenna system 500 is comprised of a retaining structure 204, an antenna flap 206, and a pivot coupling 212. The description above in relation to FIGS. 2-3 will suffice with respect to the listed components 204, 206, 212. However, it should be understood that the antenna system 500 does not provide a means 202 for detachably coupling a communications device 112 to a harness 102 (described above in relation to FIG. 1). Instead, the antenna system 500 provides a handheld antenna system 500 configured to allow a user 110 to carry the communications device 112.

Figure 6:
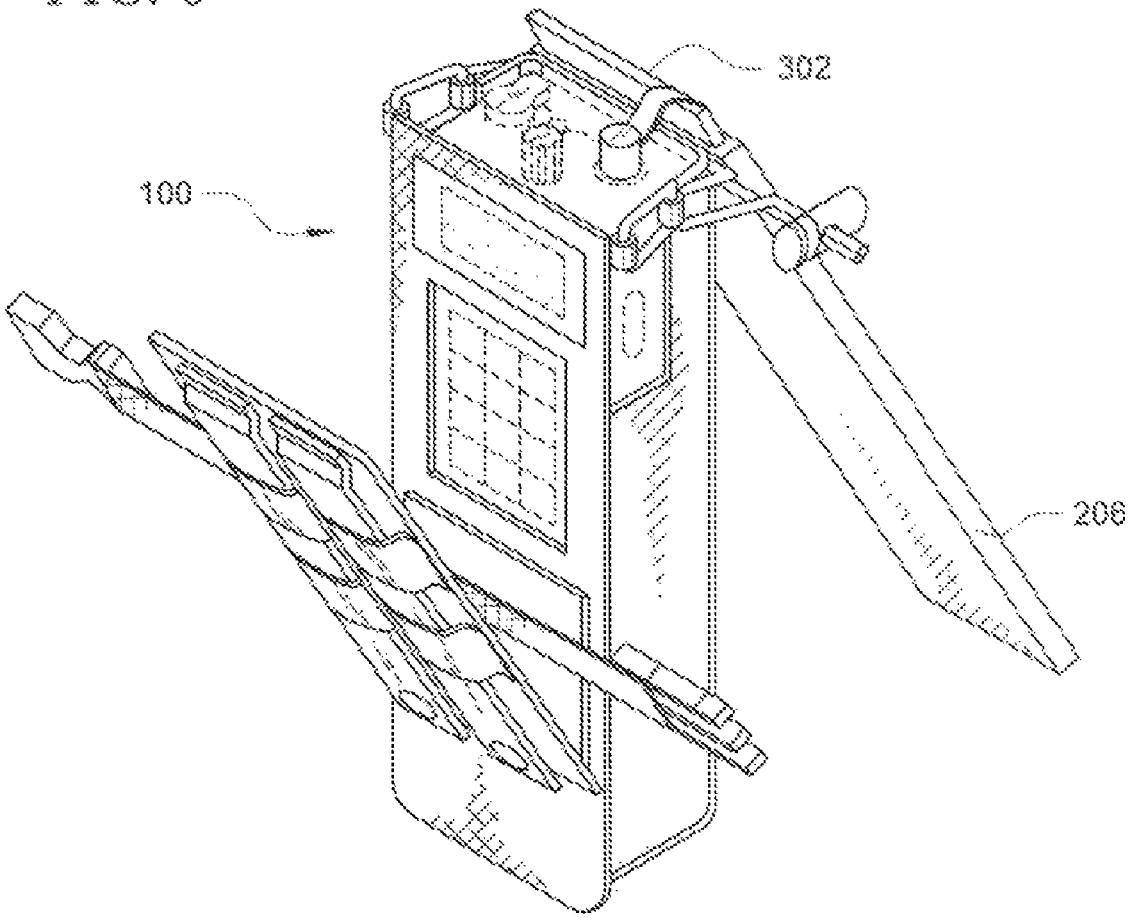
FIG. 6 is a rear perspective view of the antenna system in FIGS. 1-4 that is useful for understanding the present invention.

Referring now to FIG. 6, there is provided a rear perspective view of the antenna system 100 that is useful for understanding the present invention. As shown in the embodiment of FIG. 6, the antenna flap 206 is comprised of a planar antenna structure 302 partially disposed therein. A top perspective view of the antenna structure 302 is provided in FIG. 7A. A bottom perspective view of the antenna structure 302 is provided in FIG. 7B.

Figure 7A:
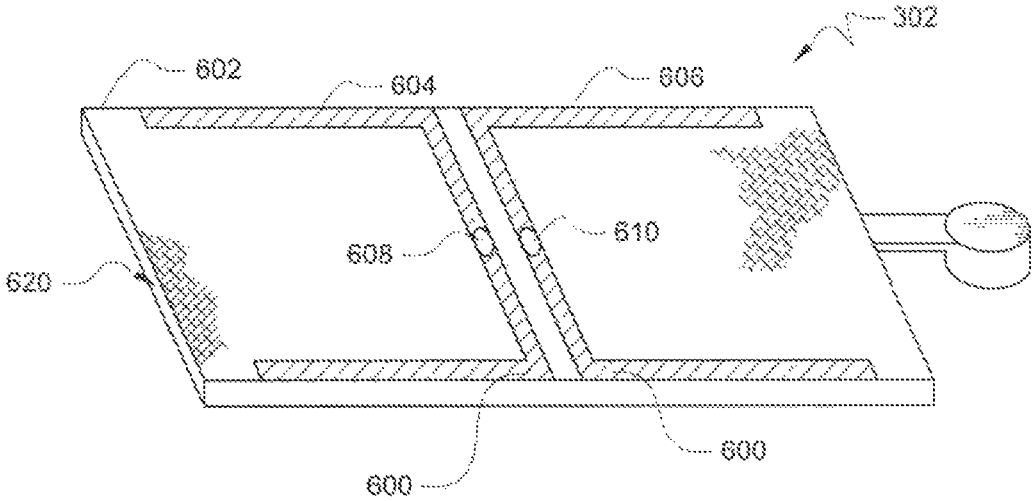
FIG. 7A is a top perspective view of an antenna structure that is useful for understanding the invention.

Referring now to FIG. 7A, an embodiment of the antenna structure 302 is comprised of a dielectric substrate 620. Dielectric substrates suitable for this purpose can include dielectric boards formed of any suitable material, such as epoxy-gloss laminate, polyimide film, ceramic or woven glass. Still, the invention is not limited in this regard. The dielectric substrate 620 is sized and shaped in accordance with a particular antenna system application. For example, the dielectric substrate 620 can be sized and shaped for insertion into a compartment 306 (described above in relation to FIG. 3) of an antenna flap 206 (described above in relation to FIGS. 2-3).

Referring again to FIG. 7A, an antenna radiating element 600 is disposed on or embedded within the dielectric substrate 620. The antenna radiating element 600 can include any known type of antenna radiating element that is suitable for positioning upon a planar substrate. In the embodiment shown, the antenna radiating element 600 is comprised of dipole antenna elements 604, 606. Each dipole antenna element 604, 606 is a conductive trace disposed on a surface 602 of the dielectric substrate 620. In this regard, it should be appreciated that the dipole antenna elements 604, 606 can be made of a conductive material, such as copper, nickel, kovar, or steel. Each dipole antenna element 604, 606 has a bore 608, 610 sized and shaped for receiving a portion of a respective input terminal coupling pin (not shown) of an antenna impedance matching network (describe below in relation to FIG. 7B).

Figure 7B:
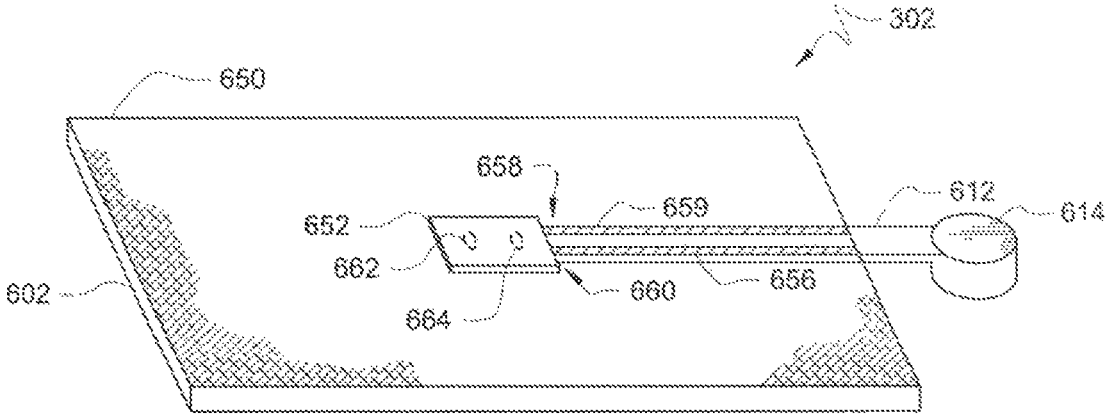
FIG. 7B is a bottom perspective view of the antenna structure in FIG. 7A that is useful for understanding the invention.

Referring now to FIG. 7B, there is provided a bottom perspective view of the dielectric substrate 620 that is useful for understanding the invention. As shown in FIG. 7B, a bottom surface 650 of the dielectric substrate 620 is comprised of an antenna impedance matching network 652. Antenna impedance matching networks are well known to persons skilled in the art. Thus, the antenna impedance matching network 652 will not be described in great detail herein. However, it should be understood that any antenna impedance matching network known in the art can be used without limitation.

Referring again to FIG. 7B, the antenna impedance matching network 652 is comprised of input terminals 658, 660 and output terminals 662, 664. The input terminals 658, 660 are electrically coupled to a radio frequency (RF) feed line, such as, conductive traces 659, 656, respectively. In this regard, it should be appreciated that this connection can be formed by any of a variety of well known techniques (for example, soldering, wire bonding, and adhesives). It should also be appreciated that the conductive traces 659, 656 can be made of a conductive material, such as copper, nickel, kovar, or steel.

As shown in FIG. 7B, the conductive traces 659, 656 are electrically coupled to a radio frequency (RF) connector 614 via a cable 612 (for example, a flat ribbon cable). Each output terminal 662, 664 is electrically coupled to a respective dipole antenna element 604, 606 (described above in relation to FIG. 6A) disposed on a side 602 of the dielectric substrate 620. This connection can be formed by any of a variety of well known techniques (for example, soldering).

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. An antenna system for a portable communication device, comprising:

a retaining structure comprising means for securing said retaining structure to said portable communication device;

an antenna flap comprising an antenna radiating element;

a first pivot coupling which pivotally secures said antenna flap to said retaining structure;

a support flap comprising at least one flap securing structure configured for securing said support flap to a user;

a second pivot coupling which pivotally secures said support flap to said retaining structure; and wherein said first pivot coupling is configured to allow said antenna flap to pivot freely relative to said retaining structure on said first pivot coupling responsive to a force of gravity acting on said antenna flap.

2. The antenna system according to claim 1, wherein said antenna flap is a planar structure.

3. The antenna system according to claim 2, wherein said planar structure has a peripheral edge which conforms to an exterior profile of said portable communication device.

4. The antenna system according to claim 2, wherein said first pivot coupling and said planar structure are each positioned so that said planar structure can automatically pivot to a position adjacent to an exterior panel of said portable communication device when said portable communication device is secured to said retaining structure.

5. The antenna system according to claim 1, wherein said antenna radiating element is disposed on an antenna structure formed of a planar dielectric substrate.

6. The antenna system according to claim 5, wherein said antenna flap further comprises an antenna impedance matching network.

7. An antenna system for a portable communication device, comprising:

a retaining structure configured as a holster in which said portable communication device can be disposed, and comprising means for securing said retaining structure to said portable communication device;

an antenna flap comprising an antenna radiating element;

a first pivot coupling which pivotally secures said antenna flap to said retaining structure; and wherein said first pivot coupling is configured to allow said antenna flap to pivot freely on said first pivot coupling responsive to a force of gravity acting on said antenna flap;

wherein said holster further comprises a second pivot coupling pivotally connects said holster to a support flap, said support flap comprising at least one flap securing structure configured for securing said support flap to a user.

8. The antenna system according to claim 7, wherein said first pivot coupling is disposed on a first side of said holster, and said second pivot coupling is disposed on a second side of said holster opposed from said first side.

9. The antenna system according to claim 7, wherein said first pivot coupling is disposed at a location on said holster which is adjacent to an upper portion of said portable communication device opposed from said second pivot coupling.

10. An antenna system for a portable communication device, comprising:

a holster in which a portable communication device can be carried;

an antenna flap comprising an antenna radiating element; and a first pivot coupling which pivotally connects said antenna flap to said holster;

a second pivot coupling which pivotally connects said holster to a support flap, said support flap comprising at least one flap securing structure configured for securing said support flap to a user.

11. The antenna system according to claim 10, wherein said first pivot coupling is configured to allow said antenna flap to pivot freely on said first pivot coupling responsive to a force of gravity acting on said antenna flap.

12. The antenna system according to claim 10, wherein said first pivot coupling is comprised of a fabric web forming a portion of said holster.

13. The antenna system according to claim 10, wherein said holster is formed from a fabric web.

14. The antenna system according to claim 10, wherein said first pivot coupling is disposed on a first side of said holster, and said second pivot coupling is disposed on a second side of said holster opposed from said first side.

15. The antenna system according to claim 10, wherein said first pivot coupling is disposed at a location on said holster which is adjacent to an upper end portion of said portable communication device opposed from said second pivot coupling.

16. The antenna system according to claim 10, wherein said antenna flap is a planar structure.

17. The antenna system according to claim 16, wherein said planar structure has a peripheral edge which conforms to an exterior profile of said portable communication device.

18. The antenna system according to claim 16, wherein said first pivot coupling and said planar structure are each positioned so that said planar structure can pivot to a position adjacent to an exterior panel of said portable communication device when said portable communication device is stored in said holster.

19. The antenna system according to claim 10, wherein said antenna radiating element is disposed on an antenna structure formed of a planar dielectric substrate.

20. The antenna system according to claim 19, wherein said antenna flap is further comprised of an antenna impedance matching network.

21. An antenna system for a portable communications device, comprising:

an antenna flap comprising an antenna structure including an antenna radiating element; and a retaining structure pivotally coupled to said antenna flap, said retaining structure configured for releasably securing said antenna flap to a portable communications device;

a support flap pivotally coupled to said retaining structure, said support flap comprising at least one flap securing for securing said support flap to a user; and at least one fastening mechanism configured for releasably securing each of said antenna flap and said support flap in a position adjacent to said portable communication device on opposing sides thereof in a closed configuration; and wherein said antenna flap and said support flap are configured to respectively pivot away from opposing sides of said portable communication device in an open configuration.

22. The antenna system according to claim 21, wherein said antenna flap is pivotally coupled at a first location on said retaining structure which is adjacent to an upper portion of said portable communication device when the retaining structure is secured to said portable communication device, and said support flap is pivotally coupled at a second location on said retaining structure which is adjacent to a lower portion of said portable communication device, opposed from the first location, when said retaining structure is secured to said portable communication device.

* * * * *